United States Patent [19]

Weber et al.

[11] Patent Number: 4,909,552

[45] Date of Patent: Mar. 20, 1990

[54] DETECTOR SEAL

[75] Inventors: George G. Weber, Maplewood; Louis J. Mattos, Carteret, both of N.J.

[73] Assignee: E. J. Brooks Company, Newark, N.J.

[21] Appl. No.: 263,881

[22] Filed: Oct. 28, 1988

[51] Int. Cl.[4] ..... B65D 33/34

[52] U.S. Cl. ..... 292/320

[58] Field of Search ..... 292/307 R, 315, 317, 292/320

[56] References Cited

U.S. PATENT DOCUMENTS 4,733,893 3/1988 Davis et al. ..... 292/320

FOREIGN PATENT DOCUMENTS 2168654 6/1986 United Kingdom ..... 292/320

*Primary Examiner*—Gary L. Smith

*Assistant Examiner*—Michael Milano

*Attorney, Agent, or Firm*—John G. Gilfillan, III; Louis G. Gillow

[57] ABSTRACT

A padlock-type security seal including a U-shaped shackle having a pair of reversely bend end portions. A body portion and a brightly colored insert are assembled to form a pair of chambers for receiving and locking the bent end portions. Movable tangs and matching cavities are formed as an integral part of the insert adjacent the chambers. The body portion has a plurality of transparent windows adjacent the cavities. Attempts to open the seal by deforming the shackle to remove the bent end portions from the chambers will result in moving the tangs into locking containment with the cavities thereby visually indicating tampering via the transparent windows.

9 Claims, 3 Drawing Sheets

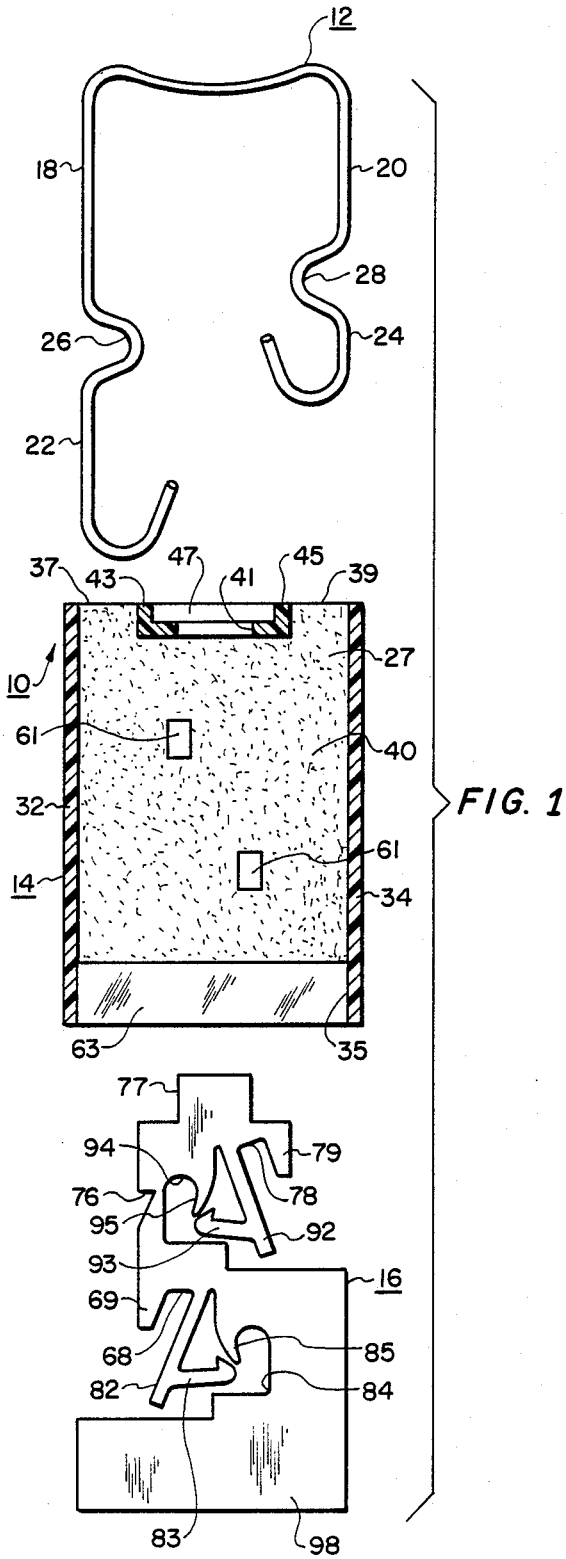
FIG. 1
FIG. 2
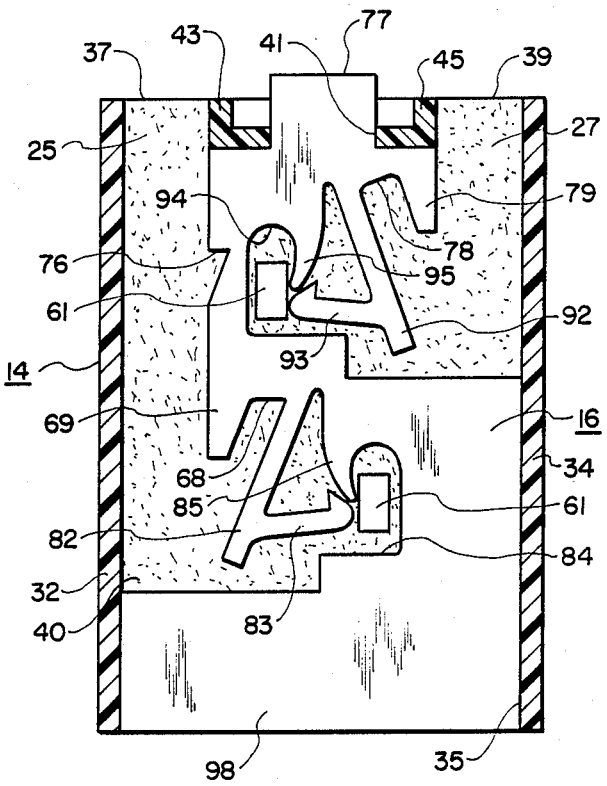
FIG. 3
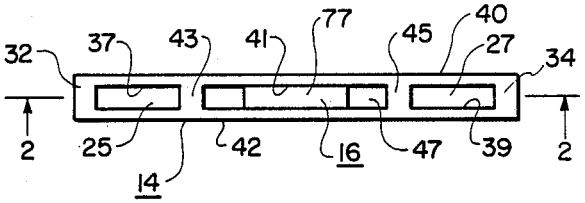

DETECTOR SEAL

BACKGROUND OF THE INVENTION

The present invention relates to security seals of the padlock type and more particularly to security seals having a visible detector to indicate tampering.

Security seals of the padlock type are generally well known and have found widespread use for sealing structures such as currency bags, closures, electric meters and the like. Examples of such seals may be found in the following U.S. Pat. Nos.: 3,485,461; 3,375,033; 3,980,332; 4,353,583; 4,278,281; and 4,687,240.

Padlock type seals generally have a plastic body with a pair of spaced cavities in which a U-shaped shackle is permanently locked. Locking the shackle is typically accomplished by having a pair of reversely bent, resilient legs engage a bump or notch located in the spaced cavities. Although such devices have served the purpose, they have not proved entirely satisfactorily because some efforts to defeat such structures have proved successful.

In some cases, it is possible to remove the shackle portion by deforming the shackle and forcing it from the cavities, and thereafter reshape the shackle and reinsert it in the cavities without any apparent evidence that the seal had been opened. Prior art attempts to improve such seals have included various means to indicate tampering under such circumstances. For example, in U.S. Pat. No. 4,687,240, there is disclosed a seal having a pigmented polypropylene body which will produce a highly visible white blush when deformed by a shackle as it is forced from the seal body. The '240 seal also has a second tamper indicating feature. The exterior of the seal body has a slot into which the shackle ends will protrude if forced sufficiently to penetrate the relatively soft polypropylene seal body. These and similar tamper-indicating features have found significant use in seals made of polypropylene and similar materials. However, seals made of such materials do have some drawbacks.

It has been found that polypropylene is not stable under prolonged exposure to ultraviolet light. For example, after many years of use on electric meters exposed to sunlight, polypropylene seals have broken down, leaving the seals vulnerable to tampering. In many cases, the bodies of such seals have been known to lose there pliability, cease blushing when deformed, crack, etc., as a result of such ultraviolet exposure for prolonged periods.

Therefore, those concerned with the development of such seals for long term use have turned to other materials that are more stable in ultraviolet environments. One popular replacement material is acrylic, an inexpensive thermoplastic that is normally colorless. However, because acrylic does not blush and is not sufficiently soft and pliable, many of the tamper indicating features used in polypropylene seals are not useful in acrylic seals. Hence, those skilled in these arts have turned to other tamper indicating structures more suitable for seals made of materials such as acrylic. For example, the above-cited U.S. Pat. No. 3,980,332 shows a seal which includes a tamper indicator in the form of a frangible insert that is used to lock the shackle but will break easily when attempts are made to separate the shackle from the seal body. Many seals of this type, however, may still be vulnerable to some forms of undetected tampering. Some seals with frangible inserts can be compromised by properly supporting the frangible inserts while pulling on the shackle. As a result, the deformed shackle can be removed from the body without breaking the frangible insert. Therefore, efforts to improve such seals have had only limited success.

SUMMARY OF THE INVENTION

It is, therefore, an object of the present invention to provide an improved tamper-resistant security seal.

In accordance with the present invention, there is provided a padlock-type security seal including a U-shaped shackle having a pair of reversely bent end portions and a body portion having a pair of chambers for receiving and locking the bent end portions. The body portion is generally translucent or opaque except for a number of strategically located transparent windows. Movable, two-state tampering indicators, formed as an integral part of the seal, are located in the chambers but spaced from the transparent windows when in one stable state. Attempts to open the present seal by deforming the shackle to remove the bent end portions from the chambers will result in moving the indicators into a second stable state wherein the indicators lie adjacent the transparent windows and may be clearly seen from the seal exterior thereby visibly indicating tampering.

The exact nature of this invention, as well as other objects and advantages thereof, will be readily apparent from consideration of the following specification relating to the annexed drawings in which:

BRIEF DESCRIPTION OF THE DRAWINGS

FIG. 1 is an exploded plan view, partly in section, of a preferred embodiment;

FIG. 2 is a sectional elevation view taken on the line 2—2 of FIG. 3 looking in the direction of the arrows;

FIG. 3 is a top view of the device shown in FIG. 2;

DETAILED DESCRIPTION OF THE PREFERRED EMBODIMENTS

Figure 4:
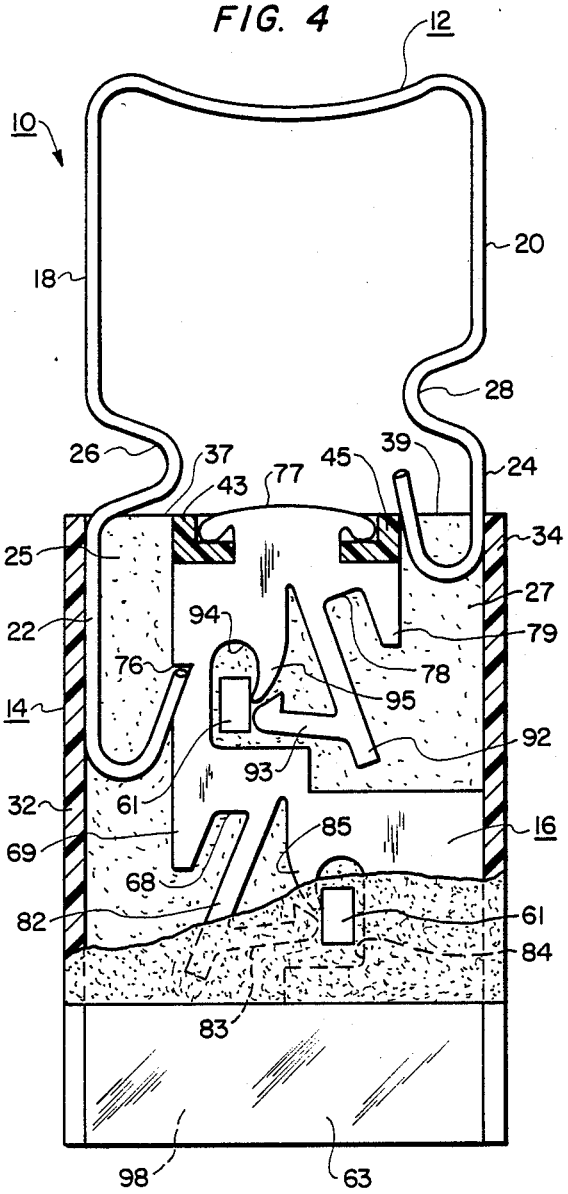
FIGS. 4–5 are plan views, partly in section, of the device shown in FIG. 1.

Referring now to the drawings, there is shown a security seal 10 having a resilient shackle 12, a seal body 14, and an insert 16. The resilient shackle 12, formed of spring wire, is generally U-shaped with a long leg 18 and a short leg 20. Legs 18, 20 have reversely bent end portions 22, 24, respectively. Legs 18, 20 are also formed with anti-picking bumps 26, 28, respectively.

The seal body 14 is made of molded plastic, preferably acrylic, that forms a flat, generally rectangular box having two parallel narrow side walls 32, 34 joined by broad side walls 40, 42 to define a narrow hollow interior.

One end of body 14 has a single rectangular opening 35 defined by walls 32, 34, 40, 42 while the opposite end has three adjacent rectangular openings 37, 39, 41. Opening 37 is defined by sidewalls 32, 40, 42 and a first L-shaped partition 43 joined to and extending between sidewalls 40, 42. Opening 39 is defined by sidewalls 34, 40, 42 and a second L-shaped partition 45 joined to and extending between sidewalls 40, 42. Partitions 43, 45 are spaced from each other to form the third opening 41 between the sidewalls 40, 42. Opening 41 is located midway between walls 32, 34 and openings 37, 39. L-shaped partitions 43, 45 cooperate with walls 40, 42 to form a cup-shaped recess 47.

Also formed on body 14 are a plurality of strategically located, transparent windows 61, 63 for a purpose described below in greater detail. The remainder of the seal body 14 is either translucent or opaque.

As mentioned earlier, the body 14 is preferably molded from acrylic. As such, the body 14 may be readily formed by first molding a transparent acrylic form of body 14, next masking or otherwise shielding the locations of the windows 61, 63, then texturizing the outside surface of body 14 by abrasion of the body surface with a sand jet or by etching the surface with an appropriate acid, and finally removing the mask or shield to expose the transparent windows 61, 63. Of course, other methods will become apparent to those skilled in these arts.

The reason that portions of the outer surface of body 14 are made translucent or opaque is to screen the interior of the seal so that its structure cannot be readily inspected by a would-be intruder. On the other hand, the purpose of the transparent windows 61 is to expose selected portions of the seal interior that are designed to indicate tampering. The transparent window 63 is provided for exposing indicia placed on a tamper resistant area on the seal interior. Such indicia could include information such as serial numbers, company names and the like.

The seal interior includes a one-piece molded insert 16 or locking member. Insert 16, also made of molded plastic, is brightly colored, e.g., red, with maximum overall dimensions substantially equal to the dimensions of the hollow interior of body 14. One end of insert 16 is narrower than the width of the hollow interior of seal body 14, thereby forming two chambers 25, 27 on opposite sides of the seal 10 for receiving the shackle legs 18, 20.

A recess 68, formed in insert 16, is defined by a rigid tongue 69 on one side and by a tang 82 on the other side that is resiliently joined to the main body of insert 16. Recess 68 communicates with chamber 25 and extends generally at a slight angle thereto. A hooked arm 83, mounted near the free end of tang 82, extends toward the center of insert 16 where an open cavity 84 is located. A rigid, hooked flange 85 defines one side of entrance opening 86.

The hooked arm 83 is generally positioned to extend from tang 82 toward the entrance of cavity 84 with the hooked end of arm 83 extending toward flange 85. The tang 82 is pivotally arranged such that upon movement of tang 82 toward the cavity 84 the flange 85 will cause the hooked arm 83 to pivot toward and into the opening of cavity 84. After the hooked arm 83 has moved sufficiently into cavity 84, the hooked end of arm 83 will snap into locking engagement with flange 85 thereby permanently locking the end of arm 83 in cavity 84 adjacent windows 61 for viewing from the exterior.

On the opposite side of insert 16, there is formed a similar locking and tamper-indicating structure including a recess 78 formed between rigid tongue 79 and resiliently mounted tang 92. Recess 78 opens into chamber 27 at a slight angle thereto. Insert 16 also includes a cavity 94 having an opening defined on one side by a rigid flange 95. A hooked arm 93 extends from tang 92 in a direction toward cavity 94. When tang 92 is rotated toward cavity 94, the flange 95 will force the end of arm 93 toward and into cavity 94. Further movement of tang 92 will cause the end of arm 93 to enter cavity 94 and snap into locking engagement with flange 95.

Transparent windows 61 are located on walls 40, 42 adjacent cavities 84, 94 at positions which will permit, from the seal 10 exterior, visual observation of the ends of hooked arms 83, 93 when they are in locking engagement with flanges 85, 95, respectively. All other portions of body 10 are opaque or translucent except for transparent windows 63 which permit visual observation of the indicia plate 98 on the end of insert 16. Indicia plate 98 may include a company name, a serial number, or similar information which may be viewed from the exterior of seal 10. Also, by viewing windows 63, an inspector can quickly determine the color one should expect to see in windows 61 if there was tampering. To enhance inspection, the insert 16 should preferably be made of a brightly colored plastic that will contrast sharply with the preferably colorless body 14.

A retaining notch 76 is formed in insert 16 above tongue 69. Notch 76 is located in chamber 25 such that the shackle 12 may be retained on the body 10 by having the end of portion 22 hooked in notch 76 (FIG. 4).

At the end opposite plate 98, the insert 16 includes a rivet 77. During assembly, rivet 77 is of a size to fit through opening 41 and extend into recess 47. The insert 16 is dimensioned so as to be easily slidable into the hollow interior of seal body 14 via opening 35. After assembly, the insert 16 is permanently fixed to seal body 14 by melting the rivet 77 to extend laterally into engagement with L-shaped partitions 43, 45. Of course, other fixing techniques for fixing insert 16 in body 10 are available to those skilled in the art. For example, large fixed portions of insert 16 ma be joined to walls 40, 42 by ultrasonic welding. It is noted at this point that the seal body 14 and insert 16 are designed such that they can be formed inexpensively from positive molding equipment, i.e., plastic molding equipment that moves in one linear direction only. For example, the cup-shaped sealed body 14 can have the outside surfaces formed by a die while a plunger can form the hollow interior via the opening 35. The insert 16 can be formed from a die shaped to form the general outline and one of the broad surfaces while a plunger, designed to move in a direction perpendicular to the plane of FIG. 2, could form the specific shapes of the elements that form the insert 16. Of course, other molding techniques are available and are well known to those skilled in these arts.

FIG. 4 shows the seal 10 in the "closed" position, i.e. with the legs 18, 20 only partly inserted in chambers 25, 27, respectively. Also, the reversely bent end portion 22 has the end thereof inserted in a notch 76 formed in insert 16 to maintain the shackle 12 coupled to the seal 10. The reversely bent end portion 24 is only slightly inserted into chamber 27. It is in this position that the seal 10 is normally shipped and supplied to users. With both legs 18, 20 inserted in the chambers 25, 27, as shown in FIG. 4, a plurality of such seals 10 may be loosely bunched together for shipping or storage without entangling with each other. Also, the short leg 20 may have its reversely bent end portion 24 removed from opening 39 to "open" the seal 10 without disturbing the position of long leg 18. In the "open" position the short leg 20 can be threaded through an appropriate structure (not shown) to be sealed in a customary fashion. An "open" seal 10 can be closed by simply flexing the resilient shackle 12 and replacing the reversely bent end portion 24 in opening 39.

Figure 5:
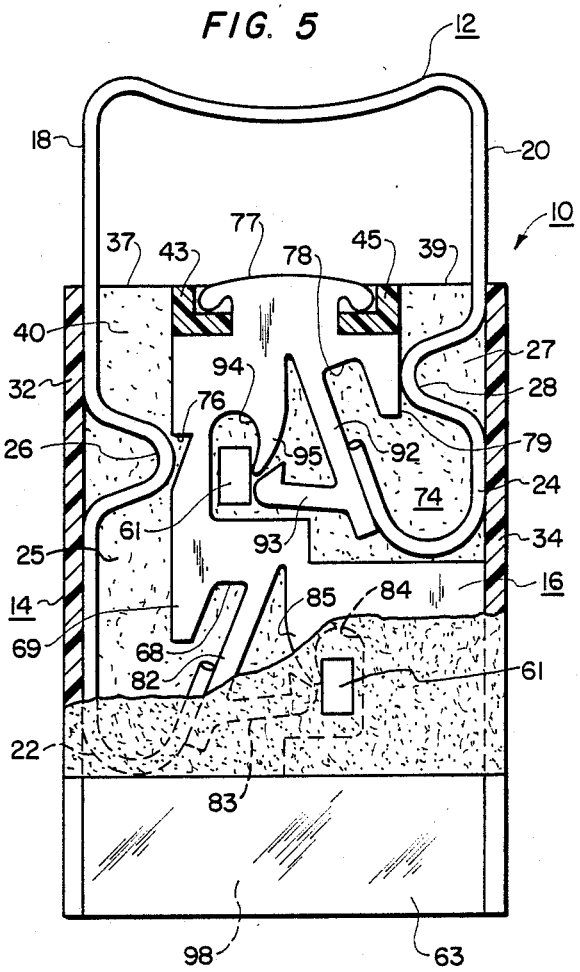

FIG. 5 depicts the seal 10 in the "locked" position. After the shackle 12 is threaded through a structure (not shown) to be sealed and "closed", it is forced fully into the chambers 25, 27. In locking the shackle 12, the reversely bent end portions 22, 24 will first be squeezed by the walls of the narrow chambers 25, 27 and then snap past the rigid tongues 69, 79, respectively. The reversely bent end portions 22, 24 will rest against the resilient tangs 82, 92 while the legs 18, 20 are held firmly against the walls 32, 34, respectively, with the aid of anti-picking bumps 26, 28.

Figure 6:
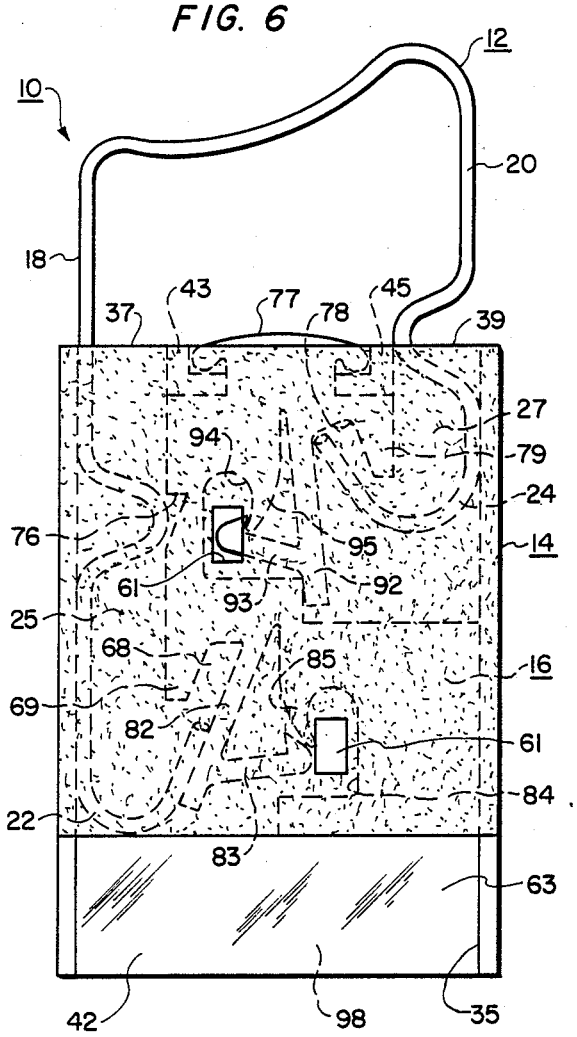
FIG. 6 is an elevation view of the device shown in FIG. 1.

FIG. 6 shows the seal 10 in the condition after or during tampering. As shown, the tang 92 has been moved from its first stable state (FIG. 5) to its second stable state wherein the tang 92 has had its hooked arm 93 forced into cavity 94 and into locking engagement with flange 95. Also, the resilient shackle 12 is shown with the reversely bent end portion 24 partly deformed and forced against the tang 92. This illustration is meant to depict one possible manner in which the shackle 12 might be deformed during or after tampering. As such, the tang 92 is moved into position to visibly indicate tampering through window 61. Of course, the shackle 12, being made of a strong resilient material, might simply return to its normal position (FIG. 5) after being deformed during tampering; or it may be permanently deformed and remain in the position shown in FIG. 6. In either case, the tang 92 will remain permanently locked in locking cavity 94 indicating that tampering has occurred. Also, tampering may occur in a manner different from that just described. For example, a picking tool might be forced into one of the chambers 25, 27 in an attempt to deform or pull one of the reversely bent end portions 22, 24 from the seal 10. In most cases, the presence of a picking tool in the chambers 25, 27 along with the shackle legs 18, 20 will be sufficient to cause the end portions 22, 24 to force the hooked arms 83, 93 into cavities 84 94 for permanent retention by flanges 85, 95 and for later viewing through windows 61.

It should be evident that under most situations in which attempts are made to remove one or both of the legs 18, 20 from a "locked" seal 10, the corresponding tangs 82, 92 will be permanently moved from a first stable state (FIG. 5) to a second stable state (FIG. 6) to visually signal tampering to an observer via one of the windows 61. The flexibility of the tangs 82, 92 and the force required to snap the hooked arms 83, 93 past the flanges 85, 95 can be varied by simply varying the shape, thicknesses, sizes, etc. of the tangs 82, 92 and cavities 84, 94. In this manner, the tampering sensitivity of the seal 10 can be varied as desired. Additionally, the insert 16 could be made from a variety of materials being more or less flexible than the body 14. One preferred choice is polypropylene. Since acrylic filters ultraviolet light, there would be no problem of material breakdown with a polypropylene insert due to sunlight exposure.

Figure 7:
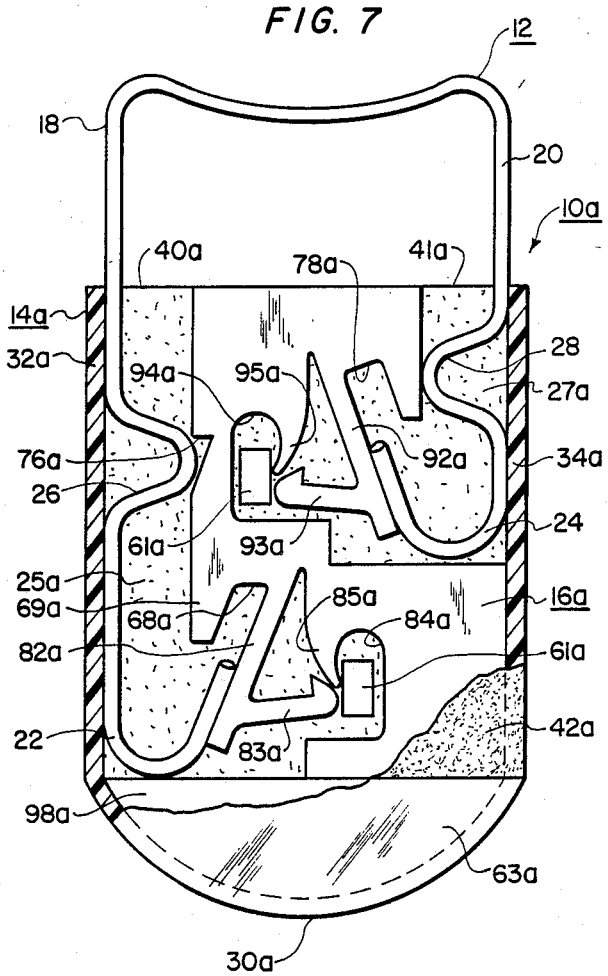
FIG. 7 is a plan view, partly in section, of a second embodiment of the invention.

FIG. 7 shows a modified seal **10*a* having a seal body 14*a* with a curved wall 30*a* at one end and an opening 41*a* at the other end. Also included are narrow side walls 32*a*, 34*a* joined by broad side walls 40*a*, 42*a*. Insert 16*a*, similar to insert 16, has a notch 76*a*, a curved indicia plate 98*a*, locking recesses 68*a*, 78*a*, tangs 82*a*, 92*a*, hooked arms 83*a*, 93*a*, cavities 84*a*, 94*a*, and flanges 85*a*, 95*a*. All of these elements function in the same manner as do the similarly numbered corresponding elements in the first embodiment. The seal 10*a* is "locked" by having the legs 18, 20 inserted into chambers 25*a*, 27*a*, respectively, such that the recesses 68*a*, 78*a* will prevent the reversely bent end portions 22, 24, respectively, from being withdrawn from chambers 25*a*, 27*a*. Transparent windows 61*a* will expose those portions of cavities 84*a*, 94*a* where hooked arms 83*a*, 93*a* are capable of being locked into engagement with flanges 85*a*, 95*a*. The first embodiment differs from the FIG. 7 embodiment primarily in the method of assembly of the seal parts. In the first embodiment, the seal 10 is assembled by sliding insert 16 through opening 35 until the rivet 77 is fully contained in opening 41. On the other hand, to assemble seal 10*a*, the insert 16*a* is slid into the opening 41*a* until the plate 98*a* seats against wall 30*a*. The body 14*a* may then be fixed in the body 14*a* by any suitable means. For example, body 14*a* may be ultrasonically welded to the insert 16*a* at selected locations such as at the indicia plate 98*a***.

Clearly, various modifications of these structures are contemplated and may be resorted to by those skilled in these arts without departing from the spirit and scope of the invention, as hereinafter defined by the appended claims, as only preferred embodiments thereof have been disclosed.

What is claimed is:

1. A security seal comprising:

a translucent hollow seal body having an aperture therein;

a locking member mounted in the hollow interior of said hollow seal body;

said locking member and said hollow seal body defining at least one elongated chamber contiguous with said aperture;

at least one cavity formed in said locking member such as to be in communication with said chamber;

a shackle having at least one leg with a resilient locking end shaped for locking engagement with said locking member;

a flexible two-position tamper indicator mounted in said chamber;

said resilient locking end having means for causing said tamper indicator to move from a first stable position in said chamber to a second stable position in said cavity when a force is exerted to unlock said leg; and means for observing said tamper indicator when in said second stable position.

2. A security seal according to claim 1 wherein said flexible tamper indicator includes a member movable between said first and second stable positions.

3. A security seal according to claim 1 wherein said means for observing said tamper indicator includes at least one transparent window adjacent said cavity wherein said flexible member is not visible to the seal exterior when in the first stable position and is visible to the seal exterior when in the second stable position.

4. A security seal according to claim 2 including means for locking at least a portion of said tamper indicator in said cavity when said tamper indicator is in said second stable position.

5. A security seal comprising:

a U-shaped resilient shackle having first and second legs each having a reversely bent end portion;

a hollow seal body having an aperture therein and at least one transparent window to permit viewing into said aperture;

a locking member mounted in the hollow interior of said hollow seal body;

said locking member and said hollow seal body defining elongated first and second chambers contiguous with said aperture;

said locking member having first and second cavities formed on opposed sides thereof in communication with said first and second chambers, respectively; and at least one flexible two-position tamper indicator mounted in said chamber.

6. A security seal according to claim 5 wherein said tamper indicator is movable between a stable position in said chamber away from said window and a stable position adjacent said window.

7. A security seal comprising:

a U-shaped resilient shackle having first and second legs each having a reversely bent end portion;

a hollow seal body having an aperture therein and at least one transparent window to permit viewing into said aperture;

a locking member mounted in the hollow interior of said hollow seal body;

said locking member and said hollow seal body defining elongated first and second chambers contiguous with said aperture;

said locking member having first and second cavities formed on opposed sides thereof in communication with said first and second chambers, respectively;

at least one two-position tamper indicator mounted in one of said chambers; and said tamper indicator is movable between a stable position in said chamber away from said window and a stable position adjacent said window.

8. A security seal according to claim 5 including first and second transparent windows formed in said hollow body, said transparent window for permitting viewing into said first and second cavities respectively, and further including first and second tamper indicators at least portions of which are displaceable from within said first and second chambers to within said first and second cavities, respectively.

9. A security seal comprising:

a U-shaped resilient shackle having shackle first and second legs each having a reversely bent end portion;

a hollow seal body having an aperture therein;

a locking member mounted in the hollow interior of said hollow seal body; said locking member and said hollow seal body defining elongated first and second chambers contiguous with said aperture;

said locking member having first and second cavities formed on opposed sides thereof in communication with said first and second chambers, respectively;

first and second two-positions tamper indicators at least portions of which are displaceable from within said first and second chambers to within said first and second cavities, respectively; and means for locking said portions of said first and second tamper indicators within said first and second cavities, respectively.

* * * * *